US008684753B2

(12) United States Patent
Zhang et al.

(10) Patent No.: US 8,684,753 B2
(45) Date of Patent: Apr. 1, 2014

(54) PLUG AND ELECTRONIC DEVICE WITH THE PLUG

(75) Inventors: Bin Zhang, Shenzhen (CN); Menglong Zhao, Shanghai (CN)

(73) Assignee: Huawei Technologies, Co., Ltd., Shenzhen (CN)

( * ) Notice: Subject to any disclaimer, the term of this patent is extended or adjusted under 35 U.S.C. 154(b) by 292 days.

(21) Appl. No.: 13/098,035

(22) Filed: Apr. 29, 2011

(65) Prior Publication Data

US 2011/0269335 A1 Nov. 3, 2011

(30) Foreign Application Priority Data

Apr. 29, 2010 (CN) ..... 2010 1 0168720

(51) Int. Cl.
*H01R 13/44* (2006.01)

(52) U.S. Cl.
USPC ..... 439/131

(58) Field of Classification Search
USPC ..... 439/131, 640
See application file for complete search history.

(56) References Cited

U.S. PATENT DOCUMENTS

| | | | | |
|---|---|---|---|---|
| 6,490,163 | B1 * | 12/2002 | Pua et al. | 361/737 |
| 6,567,273 | B1 * | 5/2003 | Liu et al. | 361/737 |
| 6,648,224 | B2 * | 11/2003 | Lee | 235/451 |
| 6,786,734 | B2 * | 9/2004 | Yu | 439/11 |
| 6,786,743 | B2 * | 9/2004 | Huang | 439/131 |
| 6,893,267 | B1 * | 5/2005 | Yueh | 439/8 |
| 7,001,192 | B1 * | 2/2006 | Yeh | 439/131 |

(Continued)

FOREIGN PATENT DOCUMENTS

| | | |
|---|---|---|
| CN | 2750525 Y | 1/2006 |
| CN | 2796172 Y | 7/2006 |

(Continued)

OTHER PUBLICATIONS

International Search Report, PCT/CN2011/073482, dated Jul. 21, 2011, 5 pages.

(Continued)

*Primary Examiner* — Neil Abrams
(74) *Attorney, Agent, or Firm* — Slater & Matsil, L.L.P.

(57) ABSTRACT

The present invention relates to electronic technologies, and in particular, to a plug and an electronic device with the plug. The present invention solves the following problem: In the conventional art, an electronic device with a plug occupies too large space in the direction vertical to the surface of an external device when the electronic device is inserted in a slot of the external device. A plug of the present invention takes on the following features: when a head end of the plug is inserted in a slot of an external device, the plug is electrically connected to the slot; a back end of the plug is electrically connected to a main circuit board of an electronic device equipped with the plug; a sliding structure is set on the plug and integrated with the electronic device equipped with the plug; and the plug can slide relative to a shell of the electronic device through the sliding structure, and a head end of the plug can slide out of an edge of the shell in a direction that intersects a maximum extension direction of the shell through the sliding structure. The electronic device with the plug includes the shell, the main circuit board located in the shell, and the plug disclosed herein. A pair of slidable plugs may be used to enable selective mounting of the device.

22 Claims, 7 Drawing Sheets

(56) References Cited

U.S. PATENT DOCUMENTS

| | | | | |
|---|---|---|---|---|
| 7,025,275 | B2 * | 4/2006 | Huang et al. | 235/486 |
| 7,025,595 | B1 * | 4/2006 | Chan et al. | 439/6 |
| 7,066,753 | B1 * | 6/2006 | Tseng | 439/259 |
| 7,113,812 | B2 * | 9/2006 | Li | 455/575.1 |
| 7,121,852 | B2 * | 10/2006 | Ng et al. | 439/131 |
| 7,125,265 | B2 * | 10/2006 | Weng | 439/131 |
| 7,179,099 | B2 * | 2/2007 | Hsieh | 439/131 |
| 7,329,136 | B2 * | 2/2008 | Su et al. | 439/172 |
| 7,357,654 | B2 * | 4/2008 | Lin et al. | 439/164 |
| 7,407,393 | B2 * | 8/2008 | Ni et al. | 439/131 |
| 7,422,454 | B1 | 9/2008 | Tang et al. | |
| 7,452,231 | B2 * | 11/2008 | Wan | 439/350 |
| 7,494,343 | B2 * | 2/2009 | Schriefer | 439/11 |
| 7,494,350 | B1 * | 2/2009 | Lee | 439/131 |
| 7,597,250 | B2 * | 10/2009 | Finn | 235/380 |
| 7,644,867 | B2 * | 1/2010 | Lin et al. | 235/486 |
| 7,658,557 | B2 * | 2/2010 | Lu | 396/428 |
| 7,778,037 | B2 * | 8/2010 | Huang | 361/752 |
| 7,815,447 | B1 * | 10/2010 | Chiang | 439/131 |
| 7,815,471 | B2 * | 10/2010 | Wu | 439/640 |
| 7,819,403 | B2 * | 10/2010 | Andre | 273/155 |
| 7,824,186 | B2 * | 11/2010 | Zhao et al. | 439/13 |
| 7,920,386 | B2 * | 4/2011 | Tsao et al. | 361/755 |
| 7,988,466 | B2 * | 8/2011 | Ng et al. | 439/131 |
| 8,029,303 | B2 * | 10/2011 | Chiang | 439/172 |
| 8,189,101 | B2 * | 5/2012 | Cummings et al. | 348/376 |
| 8,325,239 | B2 * | 12/2012 | Kaplan et al. | 348/207.1 |
| 8,333,615 | B2 * | 12/2012 | Zhao et al. | 439/660 |
| 8,348,685 | B2 * | 1/2013 | Liao et al. | 439/131 |
| 2004/0033727 | A1 * | 2/2004 | Kao | 439/660 |
| 2004/0215966 | A1 * | 10/2004 | Elteto | 713/182 |
| 2005/0037647 | A1 | 2/2005 | Le | |
| 2006/0073717 | A1 | 4/2006 | Ng et al. | |
| 2006/0084284 | A1 | 4/2006 | Hsieh | |
| 2006/0223369 | A1 * | 10/2006 | Zheng | 439/607 |
| 2008/0113546 | A1 | 5/2008 | Wan | |
| 2008/0286985 | A1 * | 11/2008 | Huang | 439/6 |
| 2009/0089496 | A1 | 4/2009 | Huang | |
| 2011/0269335 | A1 * | 11/2011 | Zhang et al. | 439/502 |

FOREIGN PATENT DOCUMENTS

| | | | |
|---|---|---|---|
| CN | 1893797 | A | 1/2007 |
| CN | 1979386 | A | 6/2007 |
| CN | 201417877 | Y | 3/2010 |
| CN | 101859940 | A | 10/2010 |
| JP | 37-22471 | | 9/1934 |
| JP | 3098622 | U | 10/2003 |
| JP | 2006-166085 | A | 6/2006 |
| JP | 2007-534034 | A | 11/2007 |
| JP | 2008-117087 | A | 5/2008 |
| JP | 2009-177996 | A | 8/2009 |
| JP | 2009-230875 | A | 10/2009 |
| WO | WO 2005/020137 | A2 | 3/2005 |

OTHER PUBLICATIONS

First Chinese Office Action, Application No. 201010168720.0, dated Nov. 24, 2011, 10 pages.

Written Opinion of the International Searching Authority received in International Application No. PCT/CN2011/073482, Applicant: Huawei Device Co., Ltd., et al., mailed Jul. 21, 2011, 5 pages.

Japanese Notice of Reason for Rejection and Translation received in Japanese Application No. 2011-103013, mailed Aug. 15, 2012, 9 pages.

Extended European Search Report, European Application No. 11164307.8-2214, Applicant: Huawei Device Co., Ltd., Dated: Jul. 1, 2011, 6 pages.

EPO Communication pursuant to Article 94(3) EPC, in corresponding EP Application No. 11 164 307.8-1808 dated Aug. 23, 2013, 5 pages.

* cited by examiner

PLUG AND ELECTRONIC DEVICE WITH THE PLUG

CROSS-REFERENCE TO RELATED APPLICATION

This application claims priority to Chinese Patent Application No. 201010168720.0, filed on Apr. 29, 2010, which is hereby incorporated by reference in its entirety.

FIELD OF THE INVENTION

The present invention relates to electronic technologies, and in particular, to a plug and an electronic device with this plug.

BACKGROUND OF THE INVENTION

With development of electronic technologies, electronic devices with a plug (for example, a Universal Serial Bus (USB) disk and a data card) have become popular portable electronic devices.

As shown in FIG. 1 and FIG. 2, an electronic device with a plug in the conventional art includes a shell 1, a main circuit board 2 in the shell 1, a plug 30 electrically connected to the main circuit board 2, and a protective cap put on the plug 30.

The shell 1 is cuboid, and the plug 30 includes a head end and a back end. When the head end of the plug 30 is inserted in a slot 41 of an external device 4, the plug 30 is electrically connected to the slot 41 shown in FIG. 2.

The back end of the plug 30 is electrically connected to the main circuit board 2.

When the plug 30 is not in use, the protective cap may be put on the head end of the plug 30.

The back end of the plug 30 is fastened to either side of the maximum extension direction (or known as a lengthwise direction) of the shell 1, and the head end of the plug 30 stretches along the maximum extension direction of the shell 1.

It is assumed that the plug 30 is a USB plug. When using an electronic device with a USB plug, a user removes the protective cap from the plug 30, and then holds the shell 1 with a hand, and inserts the head end of the plug 30 in the slot 41 of the external device 4 (such as a computer) shown in FIG. 2. After the head end of the plug 30 is inserted in the slot 41 of the external device 4, USB terminals (also known as USB pins) 302 embedded on an insulation base 301 in the plug 30 is electrically connected to the slot 41. In this way, the main circuit board 2 in the electronic device with the plug exchanges data with the external device 4 through the plug 30 and the slot 41.

The inventor of the present invention finds at least the following problems in the conventional art:

As shown in FIG. 1, in the conventional electronic device with a plug, the back end of the plug 30 is vertically fastened to either side of the maximum extension direction of the shell 1, and the head end of the plug 30 stretches along the maximum extension direction of the shell 1; after the head end of the plug 30 is inserted in the slot 41 of the external device 4 shown in FIG. 2, the shell 1 exposes itself and vertically protrudes on the external device 4. The shell 1 occupies too large space in the direction vertical to the surface of the external device 4, and other ports or other units are generally set around the slot 41 of the external device 4; therefore, when the user uses other ports or performs other operations outside the external device 4, the user may easily touch the shell 1 of the electronic device, which makes the plug 30 detached from the slot 41 of the external device 4 or even damage the plug 30 unintentionally.

SUMMARY OF THE INVENTION

Embodiments of the present invention provide a plug and an electronic device with the plug to solve the following problem in the conventional art: When an electronic device with a plug is inserted in the slot of an external device, the electronic device occupies too large space in the direction vertical to the surface of the external device.

To fulfill such objectives, the following technical solution is put forward in embodiments of the present invention:

A plug provided in an embodiment of the present invention takes on the following features: When the head end of the plug is inserted in a slot of an external device, the plug is electrically connected to the slot; the back end of the plug is electrically connected to a main circuit board of an electronic device equipped with the plug; a sliding structure is set for the plug and integrated with the electronic device equipped with the plug; and the plug can slide relative to a shell of the electronic device through the sliding structure, and the head end of the plug can slide out of an edge of the shell in a direction that intersects a maximum extension direction of the shell through the sliding structure.

An electronic device with a plug is provided in an embodiment of the present invention; the electronic device includes a shell, a main circuit board in the shell, and a first plug electrically connected to the main circuit board, where the first plug is the plug described above.

Compared with the conventional art, the technical solution of the present invention brings at least the following benefits:

The plug disclosed herein can slide relative to the shell of the electronic device equipped with the plug through the sliding structure; the head end of the plug can slide out of the edge of the shell in the direction that intersects the maximum extension direction of the shell through the sliding structure; when the head end of the plug is inserted in the slot of the external device, the plug is electrically connected to the slot; therefore, when using the electronic device with the plug disclosed herein, the user only needs to slide the head end of the plug out of the edge of the shell in the direction that intersects the maximum extension direction of the shell through the sliding structure, and then inserts the head end of the plug in a slot of an external device so that the slot is electrically connected to the plug.

When the head end of the plug disclosed herein is inserted in the slot of the external device, the angle between the surface of the external device and the shell edge parallel or almost parallel to the maximum extension direction of the shell in the embodiment of the present invention is smaller than the angle between the surface of the external device and the shell edge parallel or almost parallel to the maximum extension direction of the shell in the conventional art; therefore, the shell occupies smaller space in the direction vertical to the surface of the external device, and the problem in the conventional art that large space is occupied by an electronic device with a plug is overcome.

Meanwhile, the shell occupies smaller space in the direction vertical to the surface of the external device. Therefore, when the user uses other ports or performs other operations on the external device, the user does not tend to touch the shell of the electronic device equipped with the plug disclosed herein, which avoids unintentional action of disconnecting the plug from the slot of the external device or even damaging the plug.

After completion of using the electronic device equipped with the plug provided in the present invention, the user removes the head end of the plug from the slot of the external device, and slides the head end of the plug back into the edge of the shell through the sliding structure. Therefore, it is not necessary to set a protective cap on the head end of the plug: the cost of the protective cap is saved, and the protective cap is not prone to loss.

Another plug is provided in another embodiment of the present invention. The plug includes a first plug part and a second plug part, where: when a head end of the first plug part or a head end of the second plug part is inserted in a slot of an external device, the plug is electrically connected to the slot; a back end of the first plug part is set opposite to the back end of the second plug part, and both of the back ends are electrically connected to a main circuit board of an electronic device equipped with the plug; the first plug part is fastened to the second plug part to form a whole; a sliding structure is set for the plug and integrated with the electronic device equipped with the plug; and the plug can slide relative to a shell of the electronic device through the sliding structure, and the head end of the first plug part or the second plug part can slide out of an edge of the shell in a direction that intersects a maximum extension direction of the shell through the sliding structure.

Another electronic device with a plug is provided in an embodiment of the present invention; the electronic device includes a shell, a main circuit board in the shell, and a plug electrically connected to the main circuit board, where the plug is the plug according to the another embodiment of the present invention.

Compared with the conventional art, the technical solution of the present invention brings at least the following benefits:

The plug disclosed herein can slide relative to the shell of the electronic device equipped with the plug through a sliding structure; the head end of the first plug part or the second plug part can slide out of the edge of the shell in the direction that intersects the maximum extension direction of the shell through the sliding structure; when the head end of the first plug part or the second plug part is inserted in the slot of the external device, the plug is electrically connected to the slot; therefore, when using the electronic device with the plug disclosed herein, the user only needs to slide the head end of the first plug part or second plug part out of the edge of the shell in the direction that intersects the maximum extension direction of the shell through the sliding structure, and then inserts the head end of the first plug part or the second plug part in the slot of the external device so that the slot is electrically connected to the plug.

When the head end of the first plug part or the second plug part disclosed herein is inserted in the slot of the external device, the angle between the surface of the external device and the shell edge parallel or almost parallel to the maximum extension direction of the shell in the embodiment of the present invention is smaller than the angle between the surface of the external device and the shell edge parallel or almost parallel to the maximum extension direction of the shell in the conventional art; therefore, the shell occupies smaller space in the direction vertical to the surface of the external device, and the problem in the conventional art that large space is occupied by an electronic device with a plug is overcome.

Meanwhile, the shell occupies smaller space in the direction vertical to the surface of the external device. Therefore, when the user uses other ports or performs other operations on the external device, the user does not tend to touch the shell of the electronic device equipped with the plug disclosed herein, which avoids unintentional action of disconnecting the plug from the slot of the external device or even damaging the plug.

After completion of using the electronic device equipped with a plug, the user removes the head end of the first plug part or the second plug part from the slot of the external device, and slides the head end of the first plug part or the second plug part back to the edge of the shell through the sliding structure. Therefore, it is not necessary to set a protective cap on the head end of the first plug part or the second plug part; the cost of the protective cap is saved, and the protective cap is not prone to loss.

BRIEF DESCRIPTION OF THE DRAWINGS

To make the technical solution of the present invention or the conventional art clearer, the following briefly describes the accompanying drawings involved in the description of embodiments of the present invention or the conventional art. Apparently, the accompanying drawings briefly described are illustrative and not exhaustive, and persons of ordinary skill in the art may derive other drawings from such accompanying drawings without any creative effort.

DETAILED DESCRIPTION OF THE EMBODIMENTS

The following detailed description is given with reference to the accompanying drawings to provide a thorough understanding of the present invention. Evidently, the drawings and the detailed description are merely representative of particular embodiments of the present invention rather than all embodiments. All other embodiments, which may be derived by those skilled in the art from the embodiments given herein without any creative effort, shall fall within the scope of the present invention.

The embodiments of the present invention provide a plug and an electronic device with the plug, which occupies only small space in the direction vertical to the surface of the external device when the plug is inserted in the slot of the external device.

Plug Embodiment 1

Figure 3:
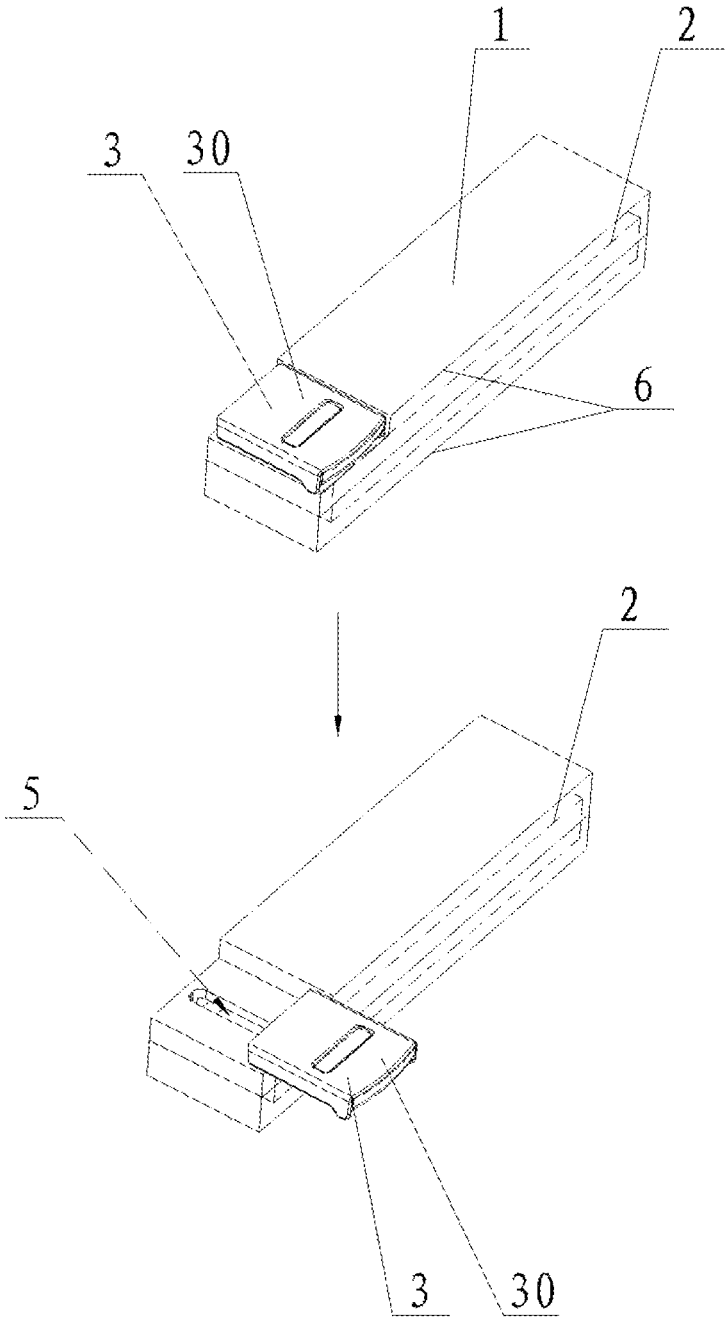
FIG. 3 is a three-dimensional diagram of an electronic device with a plug according to Embodiment 1 of the present invention.

As shown in FIG. 3, when the head end of a plug 30 according to Plug Embodiment 1 is inserted in a slot 41 of an external device 4, the plug 30 is electrically connected to the slot 41.

A back end of the plug 30 is electrically connected to a main circuit board 2 of the electronic device equipped with the plug 30.

A sliding structure 5 is set for the plug 30 and integrated with the electronic device equipped with the plug 30. The plug 30 can slide relative to a shell 1 of the electronic device through the sliding structure 5, and a head end of the plug 30 can slide out of an edge 6 of the shell 1 in the direction that intersects the maximum extension direction of the shell 1 through the sliding structure 5.

Figure 10:
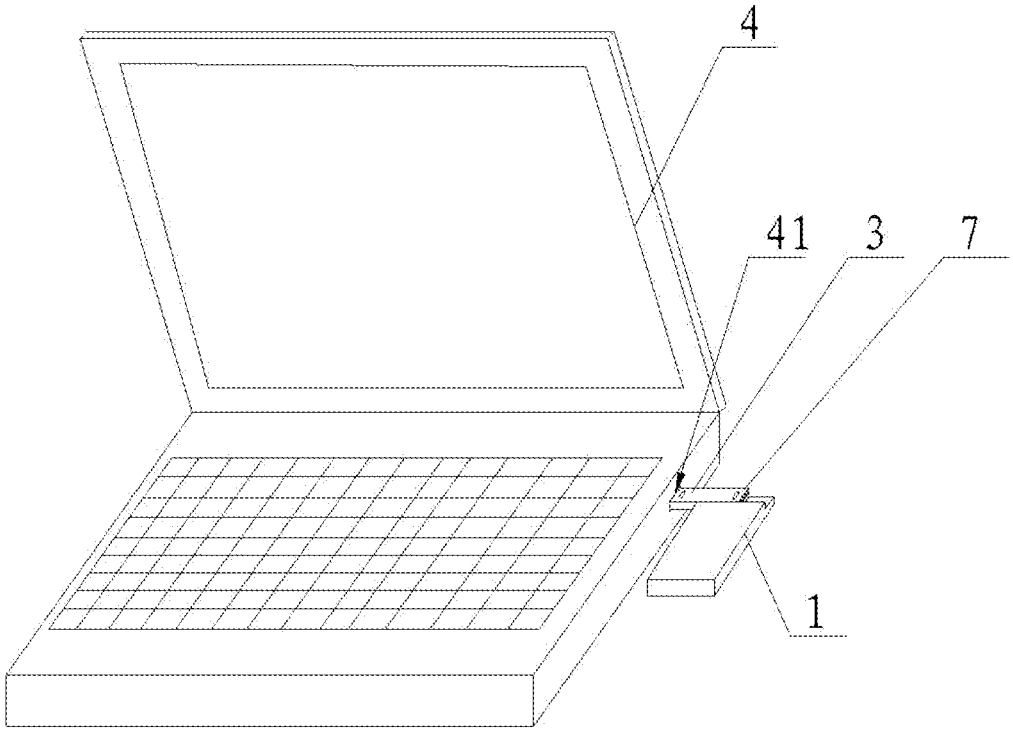
FIG. 10 is a three-dimensional diagram of an electronic device shown in FIG. 7 when the first plug part of the electronic device is inserted in a slot of an external device.

The plug 30 disclosed herein can slide relative to the shell 1 through the sliding structure 5; the head end of the plug 30 can slide out of the edge 6 of the shell 1 in the direction that intersects the maximum extension direction of the shell 1 through the sliding structure 5; when the head end of the plug 30 is inserted in the slot 41 of the external device 4 shown in FIG. 10, the plug 30 is electrically connected to the slot 41; therefore, when using the electronic device with the plug 30 disclosed herein, a user only needs to slide the head end of the plug 30 out of the edge 6 of the shell 1 in the direction that intersects the maximum extension direction of the shell 1 through the sliding structure 5, and then inserts the head end of the plug 30 in the slot 41 of the external device 4 shown in FIG. 10 so that the slot 41 is electrically connected to the plug 30.

Figure 1:
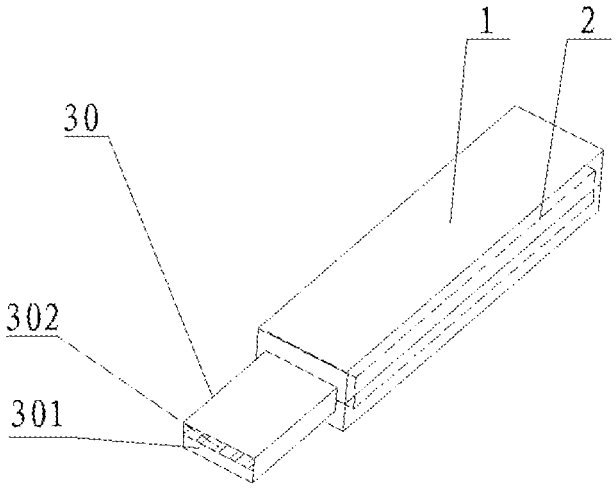
FIG 1 (Prior Art)
FIG. 1 is a three-dimensional diagram of an electronic device with a plug in the conventional art.
Figure 2:
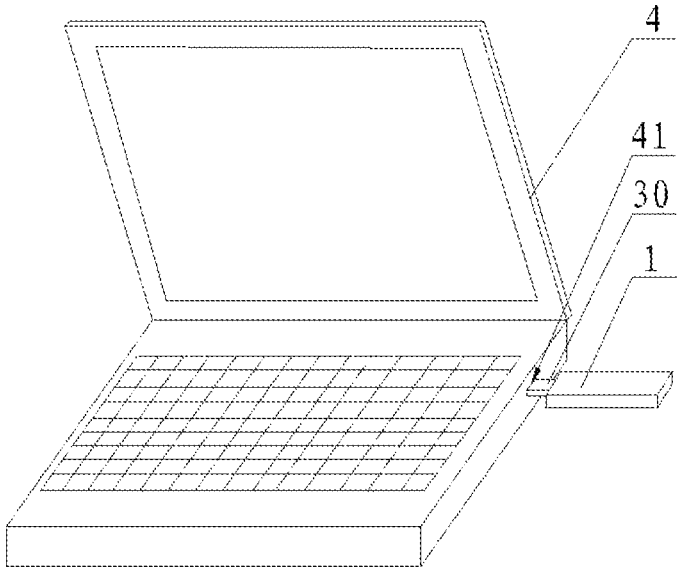
FIG 2 (Prior Art)
FIG. 2 is a three-dimensional diagram of an electronic device shown in FIG. 1 when the electronic device is inserted in a slot of an external device in the conventional art.

When the head end of the plug 30 disclosed herein is inserted in the slot 41 of the external device 4 shown in FIG. 10, the angle between the surface of the external device 4 and the edge 6 of the shell 1 parallel or almost parallel to the maximum extension direction of the shell 1 in this embodiment of the present invention is smaller than the angle between the surface of the external device 4 and the shell edge parallel or almost parallel to the maximum extension direction of the shell 1 shown in FIG. 2 in the conventional art, and preferably, the maximum extension direction of the shell 1 is parallel or almost parallel to the surface of the external device 4; therefore, the shell 1 occupies smaller space in the direction vertical to the surface of the external device 4, and the problem in the conventional art that large space is occupied by the electronic device with a plug is overcome.

Meanwhile, the shell 1 occupies smaller space in the direction vertical to the surface of the external device 4 shown in FIG. 10. Therefore, when the user uses other ports or performs other operations on the external device 4, the user does not tend to touch the shell 1 of the electronic device equipped with the plug 30 disclosed herein, which avoids unintentional action of disconnecting the plug 30 from the slot 41 of the external device 4 or even damaging the plug 30.

After completion of using the electronic device equipped with a plug 30, the user removes the head end of the plug 30 from the slot 41 of the external device 4 shown in FIG. 10, and slides the head end of the plug 30 back to the edge 6 of the shell 1 through the sliding structure 5. Therefore, it is not necessary to set a protective cap for the head end of the plug 30; the cost of the protective cap is saved, and the protective cap is not prone to loss.

The following gives a clear and thorough description about the electronic device with the plug provided in an embodiment of the present invention. It is understandable that the improvements made for the plug of the electronic device in the following embodiments are regarded as improvements for the plug described above.

Embodiment 1

As shown in FIG. 3, an electronic device with a plug is provided in this embodiment. The electronic device includes a shell 1, a main circuit board 2 in the shell 1, and a first plug 3 electrically connected to the main circuit board 2, where the first plug 3 may be the plug 30 described in the Plug Embodiment 1 above.

In this embodiment, the shell 1 may be in the shape of a cylinder, a prism, or a combination thereof. The head end of the first plug 3 can slide out of an edge 6 of the shell 1 in the direction vertical to the maximum extension direction of the shell 1.

In the shape of a cylinder, a prism, or a combination thereof, the shell 1 facilitates the user to grasp the electronic device with a plug. When the head end of the first plug 3 slides out of the edge 6 of the shell 1 in the direction vertical to the maximum extension direction of the shell 1, and, when the head end of the first plug 3 is inserted in the slot 41 of the external device 4 shown in FIG. 10, the shell 1 of the electronic device with the first plug 3 is closer to or even reaches the surface of the external device 4. In this case, the angle between the surface of the external device 4 and the shell edge parallel or almost parallel to the maximum extension direction of the shell 1 is the smallest, and the shell 1 occupies the minimum space in the direction vertical to the surface of the external device 4.

Nevertheless, when the first plug 3 in this embodiment slides out of the edge 6 of the shell 1 through a sliding structure 5, the sliding direction is not necessarily vertical to the maximum extension direction of the shell 1, but may intersect the maximum extension direction of the shell 1 at an obtuse angle or an acute angle. In practical production, the value of the angle depends on the shape of the exterior surface of the external device 4 near the slot 41 shown in FIG. 10. Generally, the exterior surface of the external device 4 near the slot 41 is vertical to the slot 41. Therefore, preferably, the first plug 3 slides relative to the shell 1 through the sliding structure 5 in the direction vertical to the maximum extension direction of the shell 1.

Preferably, the shape of the shell 1 in this embodiment is cuboid with round edges. When the shape of the shell 1 is approximate to cuboid, the maximum extension direction of the shell 1 is known as a lengthwise direction, and the direction vertical to the maximum extension direction of the shell 1 is known as a widthwise direction.

In this embodiment, the electronic device with a plug is a data card. The data card provided in this embodiment reduces the space occupied in the direction vertical to the surface of the external device 4 when the data card is inserted in a slot 41 of the external device 4 shown in FIG. 10.

The technical solution of the present invention is also applicable to other electronic devices with a plug, for example, a USB disk.

Embodiment 2

Figure 4:
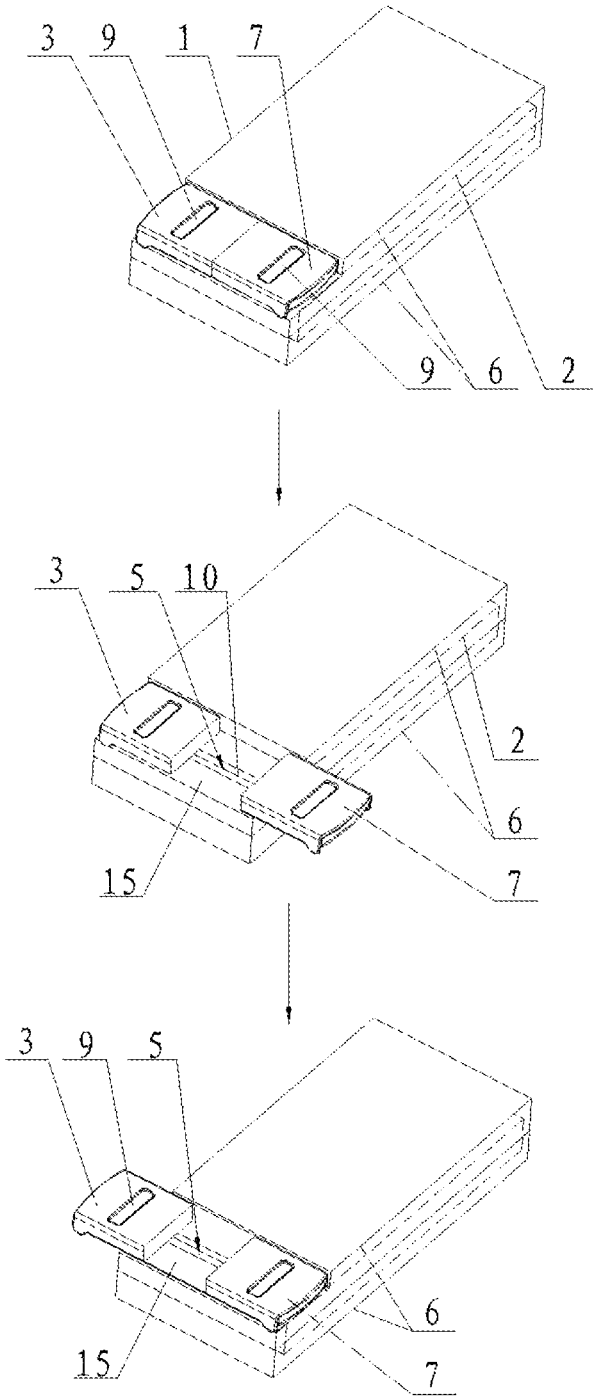
FIG. 4 shows how a first plug or a second plug in an electronic device according to Embodiment 2 of the present invention slides out of an edge of a shell in a direction that intersects a maximum extension direction of the shell.

As shown in FIG. 4, this embodiment is basically the same as Embodiment 1, but differs in: The electronic device with plugs in this embodiment further includes a second plug 7; the second plug 7 may be the plug 30 described in the Plug Embodiment 1 above; the second plug 7 has a sliding structure 5; the second plug 7 and the first plug 3 may share the same sliding structure 5 or use different sliding structures 5 separately.

The second plug 7 can slide relative to the shell 1 through the sliding structure 5, and the head end of the second plug 7 can slide out of the edge 6 of the shell 1 in the direction that intersects the maximum extension direction of the shell 1 through the sliding structure 5.

A second plug 7 is added in this embodiment, and the second plug 7 is adaptable to ports of models, standards, and types relative to different from those of the first plug 3. Therefore, the plugs are diversified, and adaptable to slots 41 shown in FIG. 10 of more various types, and adaptable to more external devices 4 with the slot 41.

The main circuit board 2 in this embodiment may be a whole, or two independent parts. When the main circuit board 2 is two independent parts, one part of the main circuit board 2 is electrically connected to the first plug 3, and the other part is electrically connected to the second plug 7. In this case, the two parts of the main circuit board 2 may have the same or different functions. For example, one part of the main circuit board 2 is a data card circuit or a USB disk circuit, the first plug 3 is a USB plug connected to the data card circuit or the USB disk circuit; and the other part of the main circuit board 2 is an electric energy storage circuit, and the second plug 7 is a power plug, which is connected to the electric energy storage circuit and obtains electric energy from the slot 41 of the external device 4 shown in FIG. 10.

In this embodiment, the first plug 3 is set opposite to the second plug 7, and the two plugs are set on either side of the maximum extension direction of the electronic device In this case, the back end of the second plug 7 and the back end of the first plug 3 face each other; the direction for the second plug 7 to slide out of the edge 6 of the shell 1 is opposite to the direction for the first plug 3 to slide out of the edge 6 of the shell 1.

In this structure, if the first plug 3 and the second plug 7 are of the same port type, may insert in the slot 41 in the external device 4 shown in FIG. 10, and provide the same functions, when the first plug 3 and the second plug 7 are inserted, the two positions of the shell 1 are symmetric along a central line of the slot 41. Therefore, depending on which direction around the external device 4 with the slot 41 has more space, the user chooses whether to insert the second plug 7 or the first plug 3 in the slot 41 of the external device 4, which further reduces the inconvenience caused by the shell 1 exposed outside the external device 4.

In this embodiment, the first plug 3 and the second plug 7 may be set on either side of the maximum extension direction of the electronic device with the plug, or set respectively on two sides of the maximum extension direction of the electronic device. The sliding track of the first plug 3 may be parallel to or intersect the sliding track of the second plug 7. The direction for the second plug 7 to slide out of the edge of the shell 1 of the electronic device with the plug may be the same as or opposite to the direction for the first plug 3 to slide out of the edge of the shell 1 of the electronic device with the plug. The positions of the first plug 3 and the second plug 7 may be set according to the requirements of the user and the space around the slot 41 of the external device 4.

The first plug 3 and/or the second plug 7 are/is a USB port that complies with one of the following standards: USB1.1, USB2.0, USB3.0, MINIUSB2.0, or MINIUSB3.0.

The first plug 3 and the second plug 7 may comply with the same standard, or comply with different standards. In practice, the first plug 3 and/or the second plug 7 may be a USB port compliant with two common standards required by the user. In this embodiment, the first plug 3 and/or the second plug 7 may be other than a USB plug, for example, power plugs.

Figure 5:
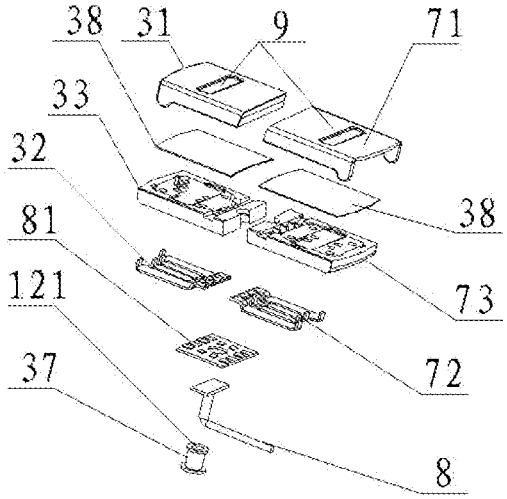
FIG. 5 is a three-dimensional disassembling view of a first plug and a second plug in an electronic device shown in FIG. 4.

When both the first plug 3 and the second plug 7 are USB ports, the structures of the plugs are shown in FIG. 4 and FIG. 5. The first plug 3 includes a first protective shell 31, first USB terminals 32, and a first insulation base 33. The second plug 7 includes a second protective shell 71, second USB terminals 72, and a second insulation base 73.

The first protective shell 31 wraps and bonds to the first insulation base 33, and the second protective shell 71 wraps and bonds to the second insulation base 73.

The first USB terminals 32 are attached to the first insulation base 33, and the second USB terminals 72 is attached to the second insulation base 73.

The first USB terminals 32 and the second USB terminals 72 in this embodiment may be set on the first insulation base 33 and the second insulation base 73 separately by other means. For example, the first USB terminals 32 may be embedded on the first insulation base 33, and the second USB terminals 72 may be embedded on the second insulation base 73; or, the first USB terminals 32 may be bonded onto the first insulation base 33 through a printing, corrosion or forming technology, and the second USB terminals 72 may be bonded onto the second insulation base 73 through a printing, corrosion or forming technology.

The printing technology may be a Surface Mounting Technology (SMT), namely, the USB terminals are picked and placed on the insulation base, or the insulation base is coated with conductive media by printing to form USB terminals. The corrosion technology may be corroding the surplus of the conductive media on the insulation base according to the shape of the USB terminals to form USB terminals. The forming technology may be a metal forming technology applied on the insulation base to form USB terminals.

The first protective shell 31 protects the first insulation base 33 and the first USB terminals 32; and the second protective shell 71 protects the second insulation base 73 and the second USB terminals 72. Preferably, the first protective shell 31 and the second protective shell 71 are made from high-strength metal materials. In this embodiment, the first protective shell 31 is fastened to the first insulation base 33, and the second protective shell 71 is fastened to the second insulation base 73, for example, bonded together using hotmelt adhesive 38.

The main circuit board 2 may be electrically connected to the first USB terminals 32 and the second USB terminals 72 respectively through a flexible conductor 8. Alternatively, the main circuit board 2 in this embodiment may be electrically connected to the first USB terminals 32 and the second USB terminals 72 respectively through two flexible conductors 8 independent of each other.

The flexible conductor 8 shown in FIG. 5 is not vulnerable to break when the first plug 3 and/or the second plug 7 slide/slides through the sliding structure 5, and does not impair the reliability of the electric connection from the first plug 3 and/or the second plug 7 to the main circuit board 2. In this embodiment, the flexible conductor 8 may be a cable or a flexible circuit board. The cable and the flexible circuit board are flexible and suitable for use in the present invention.

In this embodiment, the sliding structure 5 may be conductive and electrically connected to the main circuit board 2. In this way, the first plug 3 and/or the second plug 7 can be electrically connected to the main circuit board 2 through the sliding structure 5, which avoids use of the flexible conductor 8. When the first plug 3 and/or the second plug 7 are/is not a USB port, the first USB terminals 32 and/or the second USB terminals 72 may be pins or terminals in other ports.

As an improvement of this embodiment, as shown in FIG. 5, a connection circuit board 81 is set between the flexible conductor 8 and the first USB terminals 32, and between the flexible conductor 8 and the second USB terminals 72 in this embodiment. The flexible connector 8 is electrically connected to the first USB terminals 32 and the second USB terminals 72 through the connection circuit board 81.

Nevertheless, if the sliding structure 5 in this embodiment is a conductive structure designed to provide an electric connection between the main circuit board 2 and the first USB terminals 32, and between the main circuit board 2 and the second USB terminals 72, the connection circuit board 81 may be set between the sliding structure 5, the first USB terminals 32, and the second USB terminals 72. In this case, the sliding structure 5 is electrically connected to the first USB terminals 32 and the second USB terminals 72 through the connection circuit board 81.

The connection circuit board 81 may be welded onto the flexible conductor 8, and the first USB terminals 32 and/or the second USB terminals 72 may be welded onto the flexible conductor 8 to implement an electric connection. Alternatively, the electric connection may be implemented by other means such as riveting.

If the first plug 3 and the second plug 7 comply with the same standard (for example, both being USB ports), the first USB terminals 32 and the second USB terminals 72 may share a pin on the connection circuit board 81. In this case, the main circuit board may be electrically connected to the two plugs through a cable or a flexible circuit board, without the need of using two cables or two flexible circuit boards to get connected to the first USB terminals 32 and the second USB terminals 72 respectively. In this way, the cost of the electric connection between the first plug 3, the second plug 7, and the main circuit board 2 is saved.

In this embodiment, the first plug 3 may be fastened to or separated from the second plug 7. If the first plug 3 is fastened to the second plug 7, when the user slides the first plug 3 or the second plug 7, a larger area of the fingers of the user can exert force, and the user can slide the plug with ease.

As an improvement of this embodiment, a groove 9 is set on the sides of the first protective shell 31 and/or the second protective shell 71 shown in FIG. 5, where the side is located opposite to the sliding structure 5 shown in FIG. 4 and far away from the sliding structure 5, and the groove 9 is recessed to approach the sliding structure 5.

The effects of the groove 9 are: The friction force between the finger and the first plug 3 or the second plug 7 increases when a finger of the user pushes the first plug 3 or the second plug 7; the recessed part of the groove 9 is flexible, and elastic force applies when the first plug 3 or the second plug 7 is inserted in the slot 41 of the external device 4 shown in FIG. 10. In this way, the insertion is reliable and, when the user removes the first plug 3 or the second plug 7 from the slot 41 of the external device 4, the recessed part of the groove 9 easily separates from the slot 41, which gives good experience to the user.

The sliding structure 5 in this embodiment includes the sliding rail 37 shown in FIG. 5, and works with a sliding trough 10 shown in FIG. 4. The sliding trough 10 may be set on the shell 1, or be a part of the first plug 3 and/or the second plug 7, and fastened to the electronic device. Preferably in this embodiment, the top of the sliding rail 37 is fastened to the first plug 3 and/or the second plug 7, and the bottom of the sliding rail 37 is embedded in the sliding trough 10, and can slide along the sliding trough 10.

The first plug 3 and/or the second plug 7 can slide in the sliding trough 10 on the shell 1 through the sliding rail 37, and slide out of the edge 6 of the shell 1 along the sliding trough 10. Nevertheless, when the first plug 3 is not fastened to the second plug 7 in this embodiment, namely, when the first plug 3 is independent of the second plug 7, the sliding rail 37 in the sliding structure 5 may include two independent parts respectively connected to the first plug 3 and the second plug 7. Likewise, the sliding trough 10 may include two mutually disconnected parts which work with the two parts of the sliding rail 37 respectively.

As shown in FIG. 5, a connection through-hole 121 is set on the sliding rail 37, and the flexible conductor 8 passes through the connection through-hole 121 and the sliding trough 10. Preferably, in this embodiment, the connection through-hole 121 is located opposite to the sliding trough 10 shown in FIG. 4. The connection through-hole 121 may be set on the sliding rail 37 in the direction vertical to the sliding plane of the first plug 3 and/or the second plug 7. In this embodiment, the bottom of the sliding rail 37 is embedded in the sliding trough 10, and the size of the embedded part is greater than the width of the sliding trough 10. This structure prevents the sliding rail 37, the first plug 3, and/or the second plug 7 from leaving the sliding trough 10.

The flexible conductor 8 passes through the connection through-hole 121 and the sliding trough 10. Therefore, when the first plug 3 and the second plug 7 slide in the sliding trough 10 through the sliding rail 37, the flexible conductor 8 is not pressed. The wall of the connection through-hole 121 and the wall of the sliding trough 10 protect the flexible conductor 8, ensure the service life of the flexible conductor 8, and ensure reliability of the electric connection between the first plug 3, the second plug 7, and the main circuit board 2.

In the case that the first plug 3 is separated from the second plug 7, a sliding rail 37 may be configured respectively for the first plug 3 and the second plug 7. In the case that the first plug 3 and the second plug 7 share a flexible conductor 8, the flexible conductor 8 may choose to pass through the connection through-hole 121 of either sliding rail 37; the other sliding rail 37 may have a connection through-hole 121 or not. In the case that the first plug 3 is connected to one flexible conductor 8, and the second plug 7 is connected to another flexible conductor 8, the two flexible conductors 8 may pass through respectively the connection through-holes 121 on the sliding rails 37 corresponding to the first plug 3 and the second plug 7.

A recess 15 shown in FIG. 4 is set on the shell 1, and the sliding trough 10 is set on the bottom of the recess 15. Because the sliding trough 10 is set on the bottom of the recess 15, the first plug 3 and the second plug 7 slide back into the recess 15 when sliding toward the edge 6 of the shell 1. In this way, the structure is compact; and, when the first plug 3 and the second plug 7 are not in use, the first plug 3 and the second plug 7 slide back to the edge 6 of the shell 1 snugly so that they are not touched unintentionally and that the electronic device looks more beautiful.

Preferably, in this embodiment, the recess 15 shown in FIG. 4 is set on either side of the maximum extension direction of the shell 1. Because the space around the sides of the maximum extension direction of the shell 1 is large, it is convenient to perform operations at the recess 15 such as installing the first plug 3 and the second plug 7.

Embodiment 3

Figure 6:
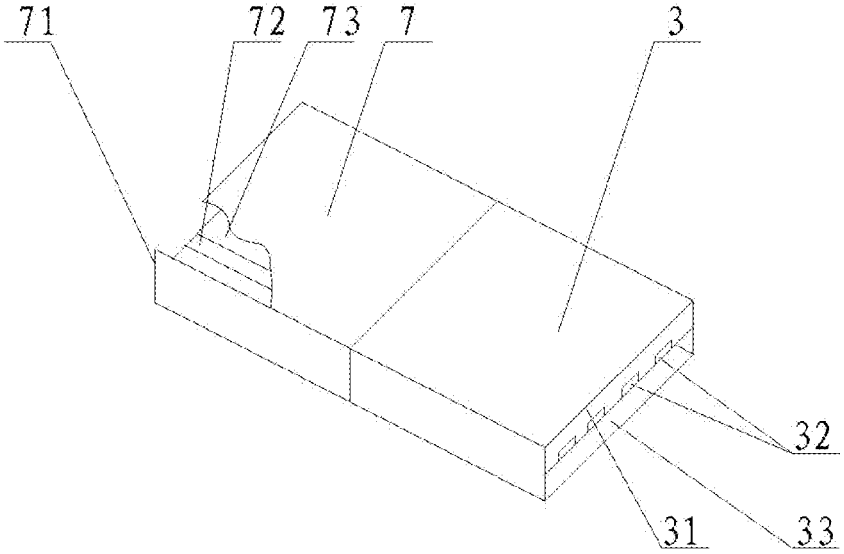
FIG. 6 is a three-dimensional diagram of a first plug and a second plug in an electronic device according to Embodiment 3 of the present invention.

As shown in FIG. 6, this embodiment is basically the same as Embodiment 2, but differs in that: In this embodiment, the first protective shell 31 and the second protective shell 71 are in the cylindrical shape, and the first insulation base 33 and the second insulation base 73 are in the plate shape.

The first insulation base 33 is bonded onto the inner wall of the first protective shell 31 far away from the sliding structure 5 shown in FIG. 4; and the first USB terminals 32 are attached to the side of the first insulation base 33 near the sliding structure 5 shown in FIG. 4.

The second insulation base 73 is bonded onto the inner wall of the second protective shell 71 near the sliding structure 5 shown in FIG. 4; and the second USB terminals 72 are attached to the side of the second insulation base 73 far away from the sliding structure 5.

The location of the first insulation base 33 and the first USB terminals 32 in the first protective shell 31 of the first plug 3 is opposite to or centrosymmetric to the location of the second insulation base 73 and the second USB terminals 72 in the second protective shell 71 of the second plug 7; and if the location of the first insulation base 33 is different from the location of the second insulation base 73, the location of the shell 1 relative to the surface of the external device 4 when the first plug 3 is inserted in the slot 41 of the external device 4 shown in FIG. 10 is different from the location of the shell 1 relative to the surface of the external device 4 when the second plug 7 is inserted in the slot 41 of the external device 4. Therefore, the user can choose the proper plug for fitting in with the slot 41 according to the space around the slot 41 of the external device 4.

In this embodiment, the location of the first insulation base 33 and the first USB terminals 32 in the first protective shell 31 of the first plug 3 may be the same as or axial-symmetric to the location of the second insulation base 73 and the second USB terminals 72 in the second protective shell 71 of the second plug 7.

Plug Embodiment 2

Figure 7:
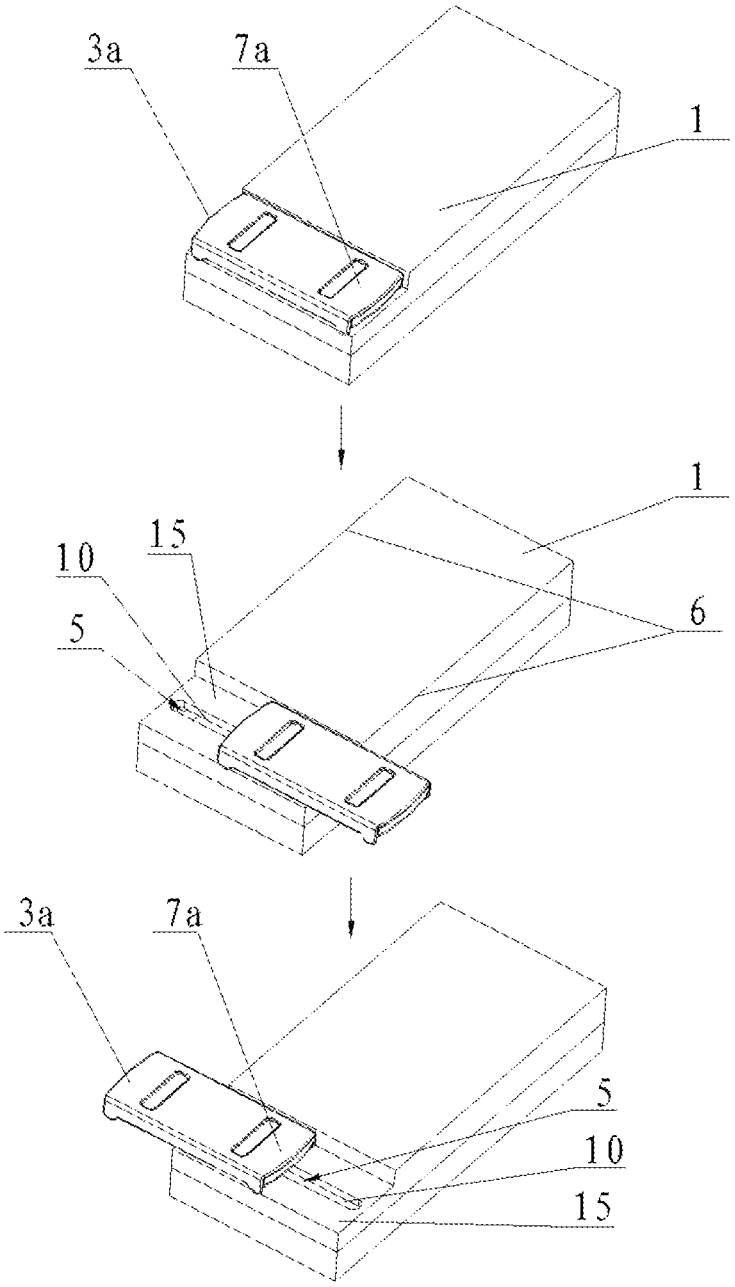
FIG. 7 is a three-dimensional diagram of an electronic device with a plug according to Embodiment 2 of the present invention.
Figure 8:
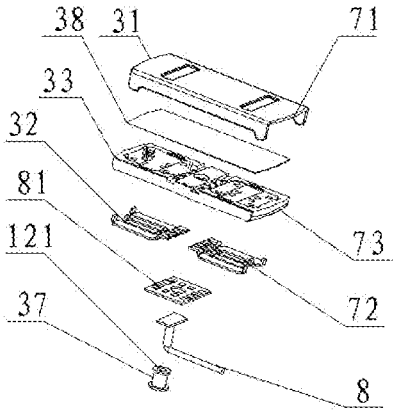
FIG. 8 is a three-dimensional disassembling view of a first plug part and a second plug part shown in FIG. 7.
Figure 9:
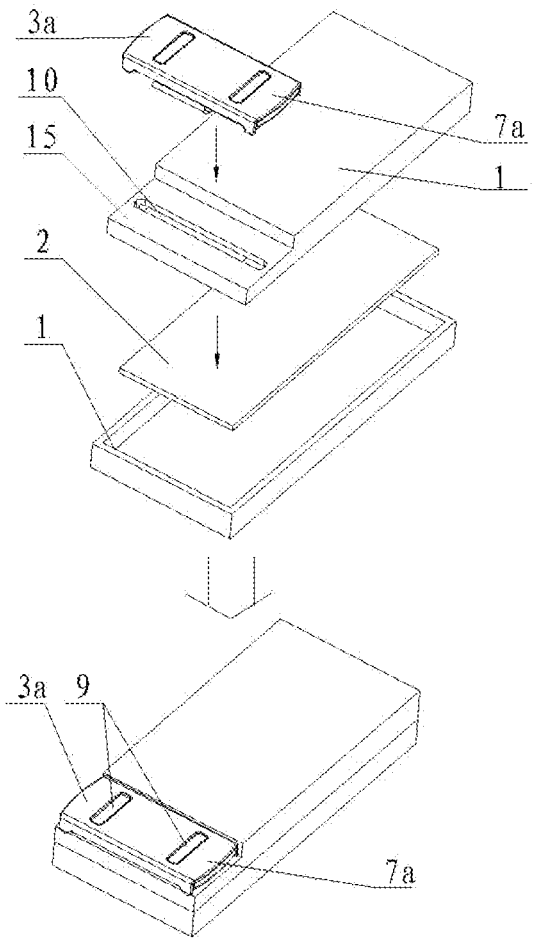
FIG. 9 shows an assembly process of an electronic device with a plug shown in FIG. 7 according to Embodiment 2 of the present invention.

As shown in FIG. 7, FIG. 8, and FIG. 9, the plug provided in this embodiment is basically the same as the plug provided in Plug Embodiment 1, Embodiment 1, Embodiment 2, and Embodiment 3, but differs in that: The plug provided in this embodiment includes the first plug part 3*a* and the second plug part 7*a* shown in FIG. 7.

When the head end of the first plug part 3*a* or the head end of the second plug part 7*a* is inserted in a slot 41 of an external device 4 shown in FIG. 10, the plug is electrically connected to the slot 41.

The back end of the first plug part 3*a* is set opposite to the back end of the second plug part 7*a*, and both of the back ends are electrically connected to a main circuit board 2 of an electronic device equipped with the plug.

The first plug part 3*a* is fastened to the second plug part 7*a* to form a whole.

A sliding structure 5 is set on the plug and integrated with the electronic device equipped with the plug.

The plug can slide relative to the shell 1 of the electronic device through the sliding structure 5, and the head end of the first plug part 3*a* or the second plug part 7*a* can slide out of the edge 6 of the shell 1 in the direction that intersects a maximum extension direction of the shell 1 through the sliding structure 5.

Like Plug Embodiment 1 above, the plug disclosed in this embodiment can slide relative to the shell 1 of the electronic device equipped with the plug through a sliding structure 5 shown in FIG. 7; the head end of the first plug part 3*a* or the second plug part 7*a* of the plug can slide out of the edge 6 of the shell 1 in the direction that intersects the maximum extension direction of the shell 1 through the sliding structure 5; when the head end of the first plug part 3*a* or the second plug part 7*a* is inserted in the slot 41 of the external device 4, the plug is electrically connected to the slot 41; therefore, when using the electronic device with the plug disclosed herein, the user only needs to slide the head end of the first plug part 3*a* or the second plug part 7*a* out of the edge 6 of the shell 1 in the direction that intersects the maximum extension direction of the shell 1 through the sliding structure, and then may insert the head end of the first plug part 3*a* or second plug part 7*a* in the slot 41 of the external device 4 so that the slot 41 is electrically connected to the plug.

When the head end of the first plug part 3*a* or the second plug part 7*a* disclosed in this embodiment is inserted in the slot 41 of the external device 4, the angle between the surface of the external device 4 and the shell edge 6 parallel or almost parallel to the maximum extension direction of the shell 1 in this embodiment of the present invention is smaller than the angle between the surface of the external device 4 and the shell edge 6 parallel or almost parallel to the maximum extension direction of the shell 1 in the conventional art shown in FIG. 2; therefore, the shell 1 occupies smaller space in the direction vertical to the surface of the external device 4, and the problem in the conventional art that large space is occupied by an electronic device with a plug is overcome.

Meanwhile, the shell 1 occupies smaller space in the direction vertical to the surface of the external device 4. Therefore, when the user uses other ports or performs other operations on the external device 4, the user does not tend to touch the shell 1 of the electronic device equipped with the plug disclosed herein, which avoids unintentional action of disconnecting the plug of the electronic device from the slot 41 of the external device 4 or even damaging the plug.

After completion of using the electronic device equipped with a plug, the user removes the head end of the first plug part 3*a* or second plug part 7*a* from the slot 41 of the external device 4, and slides the head end of the first plug part 3*a* or second plug part 7*a* back to the edge 6 of the shell 1 through the sliding structure 5. Therefore, it is not necessary to set a protective cap for the head end of the first plug part 3*a* or second plug part 7*a*, the cost of the protective cap is saved, and the protective cap is not prone to loss.

The back end of the first plug part 3*a* and the back end of the second plug part 7*a* are electrically connected to the main circuit board 2 (shown in FIG. 9) of the electronic device with the plug through the flexible conductor 8 shown in FIG. 8; or, the back end of the first plug part 3*a* and the back end of the second plug part 7*a* are electrically connected to the main circuit board 2 of the electronic device with the plug through the conductive sliding structure 5.

The flexible conductor 8 is flexible and invulnerable to damage when the first plug part 3*a* and the second plug part 7*a* slide on the shell 1 through the sliding structure 5, and does not impair the reliability of the electric connection between the back end of the first plug part 3*a* and/or the second plug part 7*a* and the main circuit board 2.

When the back end of the first plug part 3*a* and the back end of the second plug part 7*a* are electrically connected to the main circuit board 2 of the electronic device with the plug through the conductive sliding structure 5, the sliding structure 5 may be set as a conductive structure and electrically connected to the main circuit board 2. In this way, it is not necessary to set a flexible conductor 8 between the first plug part 3*a* and the main circuit board 2, or between the second plug part 7*a* and the main circuit board 2, which further saves the cost and space.

The sliding structure 5 in this embodiment includes a sliding rail 37. The top of the sliding rail 37 is fastened to the plug, and the bottom of the sliding rail 37 may be embedded in the matched sliding trough 10 and may slide along the sliding trough 10. The sliding structure 5 that matches the sliding rail 37 and the sliding trough 10 is simply structured, easily assembled and set, and slide reliably. The sliding structure 5 in this embodiment further includes a sliding trough 10, which is fastened to the electronic device with the plug. The first plug part 3*a* and the second plug part 7*a* in this structure are integrated with the electronic device with the plug more compactly, which reduces the size of the electronic device with the plug. Preferably, the sliding trough 10 is set on the shell 1 of the electronic device with the plug.

Through a flexible conductor 8, the back end of the first plug part 3*a* and the back end of the second plug part 7*a* are electrically connected to the main circuit board 2 of the electronic device equipped with the plug. A connection through-hole 121 is set on the sliding rail 37, and the flexible conductor 8 passes through the connection through-hole 121 and the sliding trough 10 that matches the sliding rail 37.

The flexible conductor 8 passes through the connection through-hole 121 and the sliding trough 10. Therefore, when the first plug part 3*a* and the second plug part 7*a* slide in the sliding trough 10 through the sliding rail 37, the flexible conductor 8 is not pressed. The wall of the connection through-hole 121 and the wall of the sliding trough 10 protect the flexible conductor 8, ensure the service life of the flexible conductor 8, and ensure reliability of the electric connection between the first plug part 3*a*, the second plug part 7*a*, and the main circuit board 2.

A connection circuit board 81 is set between the flexible conductor 8 and the back end of the first plug part 3*a*, and between the flexible conductor 8 and the back end of the second plug part 7*a*. The flexible connector 8 is electrically connected to the back end of the first plug part 3*a* and the back end of the second plug part 7*a* through the connection circuit board 81.

The head end of the plug slides out of the edge 6 of the shell 1 in the direction vertical to the maximum extension direction of the shell 1. Generally, the exterior surface of the external device 4 near the slot 41 is vertical to the slot 41. Therefore, when the head end of the plug slides out of the edge 6 of the shell 1 in the direction vertical to the maximum extension direction of the shell 1, the shell 1 of the electronic device with the plug occupies the minimum space in the direction vertical to the surface of the external device 4.

As an improvement of this embodiment, the first plug part 3*a* and the second plug part 7*a* in this embodiment (shown in FIG. 8) are USB plugs; the first plug part 3*a* includes a first protective shell 31, first USB terminals 32, and a first insulation base 33; and the second plug part 7*a* includes a second protective shell 71, second USB terminals 72, and a second insulation base 73.

The first protective shell 31 wraps and bonds to the first insulation base 33, and the second protective shell 71 wraps and bonds to the second insulation base 73.

The first USB terminals 32 are attached to the first insulation base 33, and the second USB terminals 72 are attached to the second insulation base 73.

The back ends of the first USB terminals 32 are electrically connected to the main circuit board 2 of the electronic device equipped with the plug, and the back ends of the second USB terminals 72 are electrically connected to the main circuit board 2 of the electronic device equipped with the plug.

The first protective shell 31 and the second protective shell 71 are an integrated structure, the first insulation base 33 and the second insulation base 73 are an integrated structure, and the back ends of the second USB terminals 72 are set opposite to the backs end of the first USB terminals 32.

This structure ensures a reliable connection between the first plug part 3*a* and the second plug part 7*a*, and ensures that the structure is manufactured at a single attempt. Therefore, the production efficiency of the plugs disclosed herein is improved, and the production cost is reduced.

Another electronic device with a plug is provided in an embodiment of the present invention. The electronic device includes a shell 1, a main circuit board 2 in the shell 1, and a plug electrically connected to the main circuit board 2; and the plug may be the plug described above in Plug Embodiment 2.

The plug provided in Plug Embodiment 2 reduces the space occupied by the electronic device with this plug in the direction vertical to the surface of the external device 4 when the electronic device is inserted in a slot 41 of the external device 4 shown in FIG. 10.

Like the plug provided in Plug Embodiment 1 above, the plug provided in Plug Embodiment 2 is applicable to other electronic devices with a plug, for example, a USB disk.

The above descriptions are merely exemplary embodiments of the present invention, but not intended to limit the scope of the present invention. Any modifications, variations or replacements that may be easily derived by those skilled in the art shall fall within the scope of the present invention. Therefore, the scope of the present invention is subject to the appended claims.

What is claimed is:

1. An electronic device, comprising: a shell, a main circuit board in the shell, and a plug electrically connected to the main circuit board, the plug comprises:

a first plug part comprising a first protective shell, first USB terminals and a first insulation base, wherein the first protective shell wraps and bonds to the first insulation base, the first USB terminals are attached to the first insulation base, back ends of the first USB terminals are electrically connected to the main circuit board of the electronic device equipped with the whole plug; and a second plug part comprising a second protective shell, second USB terminals and a second insulation base, wherein the second protective shell wraps and bonds to the second insulation base, the second USB terminals are attached to the second insulation base, back ends of the second USB terminals are electrically connected to the main circuit board of the electronic device equipped with whole the plug;

the first protective shell and the second protective shell are an integrated structure, the first insulation base and the second insulation base are an integrated structure, and the back ends of the second USB terminals are set opposite to the back ends of the first USB terminals;

wherein, when a head end of the first plug part or a head end of the second plug part is inserted in a slot of an external device, the whole plug is electrically connected to the slot;

wherein a back end of the first plug part is set opposite to a back end of the second plug part and both of the back ends are electrically connected to a main circuit board of an electronic device equipped with the whole plug;

wherein the first plug part is fastened to the second plug part to form the whole plug;

wherein a sliding structure is set on the whole plug and integrated with the electronic device equipped with the whole plug; and wherein the whole plug can slide relative to a shell of the electronic device through the sliding structure, and the head end of the first plug part or the second plug part can slide out of an edge of the shell in a direction that intersects a maximum extension direction of the shell through the sliding structure.

2. The electronic device according to claim 1, wherein the back end of the first plug part and the back end of the second plug part are electrically connected to the main circuit board of the electronic device with the whole plug through a flexible conductor; or the back end of the first plug part and the back end of the second plug part are electrically connected to the main circuit board of the electronic device with the whole plug through the sliding structure that is conductive.

3. The electronic device according to claim 1, wherein:

the sliding structure comprises a sliding rail;

a top of the sliding rail is fastened to the whole plug; and a bottom of the sliding rail may be embedded in a matched sliding trough and may slide along the sliding trough.

4. The electronic device according to claim 3, wherein the sliding structure further comprises the sliding trough, wherein the sliding trough is fastened to the electronic device with the whole plug.

5. The electronic device according to claim 4, wherein:

the back end of the first plug part and the back end of the second plug part are electrically connected to the main circuit board of the electronic device equipped with the whole plug through a flexible conductor;

a connection through-hole is set on the sliding rail, and the flexible conductor passes through the connection through-hole and the sliding trough that matches the sliding rail.

6. The electronic device according to claim 4, wherein:

a connection circuit board is set between the flexible conductor and the back end of the first plug part, and between the flexible conductor and the back end of the second plug part; and the flexible connector is electrically connected to the back end of the first plug part and the back end of the second plug part through the connection circuit board.

7. The electronic device according to claim 1, wherein when the head end of the whole plug slides out of the edge of the shell, the sliding direction is vertical to the maximum extension direction of the shell or intersects the maximum extension direction of the shell at an obtuse angle or an acute angle.

8. The electronic device according to claim 1, wherein:

a groove is set on a side of the first protective shell and/or the second protective shell, wherein the side is located opposite to the sliding structure and far away from the sliding structure, and the groove is recessed to approach the sliding structure.

9. The electronic device according to claim 1, wherein:

the first protective shell and the second protective shell are in the cylindrical shape and the first insulation base and the second insulation base are in the plate shape;

the first insulation base is bonded onto an inner wall of the first protective shell far away from the sliding structure; and the first USB terminals are attached to a side of the first insulation base near the sliding structure; and the second insulation base is bonded onto an inner wall of the second protective shell near the sliding structure; and the second USB terminals are attached to a side of the second insulation base far away from the sliding structure.

10. The electronic device according to claim 1, wherein the back ends of the first USB terminals are electrically connected to the main circuit board of the electronic device equipped with the whole plug through a flexible conductor, and wherein the back ends of the second USB terminals are electrically connected to the main circuit board of the electronic device equipped with the whole plug.

11. The electronic device according to claim 10, wherein a connection circuit board is set between the flexible conductor and the first USB terminals and between the flexible conductor and the second USB terminals; and the flexible connector is electrically connected to the back ends of the first USB terminals and the back ends of the second USB terminals through the connection circuit board.

12. The electronic device according to claim 11, wherein the first USB terminals and the second USB terminals share pins of the connection circuit board when the first USB terminals and the second USB terminals are electrically connected to the connection circuit board.

13. The electronic device according to claim 1, wherein the electronic device is a data card.

14. An electronic device with a plug, comprising a shell, a main circuit circuit board in the shell, the plug comprises: a first plug and a second plug, wherein the first plug is electrically connected to the main circuit board and is set opposite to the second plug; the first plug and second plug are set on either side of the maximum extension direction of the electronic device;

wherein the first plug comprises a head end; and a back end;

wherein, when the head end of the first plug/the second plug is inserted in a slot of an external device, the first plug is electrically connected to the slot;

wherein the back end of the first plug is configured to be electrically connected to a main circuit board of an electronic device equipped with the first plug;

wherein the first plug can slide relative to a shell of the electronic device through a sliding structure that is set on the plug and integrated with the electronic device equipped with the first plug; and wherein the head end of the first plug can slide out of an edge of the shell in a direction that intersects a maximum extension direction of the shell through the sliding structure.

15. The electronic device according to claim 14, wherein the first plug is a Universal Serial Bus (USB) port that complies with one of the following standards: USB1.1, USB2.0, USB3.0, MINIUSB2.0, or MINIUSB3.0.

16. The electronic device according to claim 14, the first plug comprises a protective shell, USB terminals, and an insulation base, the protective shell wraps and bonds to the insulation base; the USB terminals are attached to the insulation base; and back ends of the USB terminals are electrically connected to the main circuit board of the electronic device equipped with the first plug.

17. The electronic device according to claim 14, wherein the back ends of the USB terminals are electrically connected to the main circuit board of the electronic device equipped with the first plug through a flexible conductor, or, the back ends of the USB terminals are electrically connected to the main circuit board of the electronic device equipped with the first plug through the sliding structure that is conductive.

18. The electronic device according to claim 14, wherein a groove is set on a side of the protective shell, wherein the side is located opposite to the sliding structure and far away from the sliding structure, and the groove is recessed to approach the sliding structure.

19. The electronic device according to claim 14, wherein:

the sliding structure comprises a sliding rail;

a top of the sliding rail is fastened to the first plug; and a bottom of the sliding rail is configured so it can be embedded in a matched sliding trough and can slide along the sliding trough.

20. The electronic device according to claim 14, wherein the sliding structure further comprises the sliding trough, wherein the sliding trough is fastened to the electronic device with the first plug.

21. The electronic device according to claim 14, wherein the back end of the first plug is electrically connected to the main circuit board of the electronic device equipped with the first plug through a flexible conductor;

a connection through-hole is set on the sliding rail, and the flexible conductor passes through the connection through-hole and the sliding trough that matches the sliding rail.

22. The electronic device according to claim 14, wherein when the head end of the first plug slides out of the edge of the shell, the sliding direction is vertical to the maximum extension direction of the shell or intersects the maximum extension direction of the shell at an obtuse angle or an acute angle.

* * * * *

UNITED STATES PATENT AND TRADEMARK OFFICE

CERTIFICATE OF CORRECTION

PATENT NO. : 8,684,753 B2
APPLICATION NO. : 13/098035
DATED : April 1, 2014
INVENTOR(S) : Bin Zhang and Menglong Zhao It is certified that error appears in the above-identified patent and that said Letters Patent is hereby corrected as shown below:

On the Title Page, Item (73) Assignee, delete "Huawei Technologies, Co., Ltd., Shenzhen (CN)" and insert --Huawei Device, Co., Ltd., Shenzhen (CN)--.

Signed and Sealed this
Fourteenth Day of July, 2015

Michelle K. Lee

Michelle K. Lee
*Director of the United States Patent and Trademark Office*